US006816671B1

(12) United States Patent
Reddy et al.

(10) Patent No.: US 6,816,671 B1
(45) Date of Patent: Nov. 9, 2004

(54) MID TEMPERATURE PLASMA DEVICE

(75) Inventors: Ganta Reddy, Cincinnati, OH (US); Jainagesh Sekhar, Cincinnati, OH (US)

(73) Assignee: Micropyretics Heaters International, Inc., Cincinnati, OH (US)

( * ) Notice: Subject to any disclaimer, the term of this patent is extended or adjusted under 35 U.S.C. 154(b) by 0 days.

(21) Appl. No.: 10/725,616

(22) Filed: Dec. 3, 2003

(51) Int. Cl.[7] ..... F24H 3/00
(52) U.S. Cl. ..... 392/485; 219/121.36; 219/121.11
(58) Field of Search ..... 392/485, 488; 219/121.11, 121.36, 121.44, 121.45, 121.48

(56) References Cited

U.S. PATENT DOCUMENTS 5,963,709 A * 10/1999 Staples et al. ..... 392/488
6,099,978 A * 8/2000 Sekhar ..... 428/688

* cited by examiner

*Primary Examiner*—Thor Campbell

(57) ABSTRACT

This invention relates to the field of medium temperature plasma production device with a novelty where the plasma is created and transferred convectively to a part.

32 Claims, 2 Drawing Sheets

Side perspective view of the plasma device.

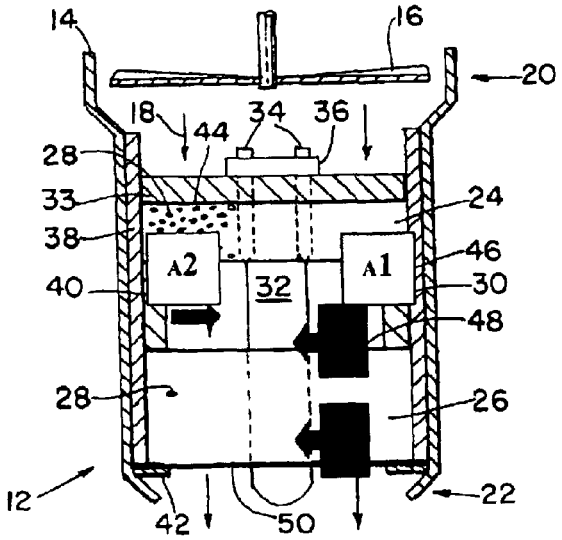
Figure 1. Side perspective view of the plasma device.

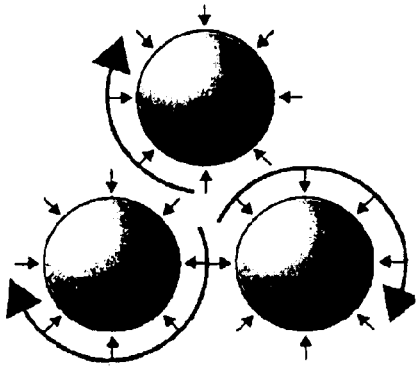
Figure 2. Plasma enhanced convection heat transfer.

MID TEMPERATURE PLASMA DEVICE

A plasma is an electrically conductive gas containing charged particles. When atoms of a gas are excited to high energy levels, the atoms loose hold of some of their electrons and become ionized producing a plasma containing electrically charged particles - ions and electrons. It is well known as shown in the example below that this dissociation is key to processing powders.

The proposed invention is about a new device which produces an unique convective plasma in the $10^3$ C temperature range (mid temperature plasma). The bulk of fundamental plasma research has mostly been concentrated on very high density, high temperature plasmas or cold room temperature plasmas. When such plasmas are used for materials processing the processing is also mostly carried out inside the plasma chamber whereas the proposed plasma device is a convective plasma generator capable of transfer along channels. Although very high temperature plasmas are now commonly available, almost all metallurgical processing work involves temperatures of the order of $10^3$ C which falls in-between the two extremes where the bulk of plasma research has been carried out. Consequently, most of plasma devices have never been able to assist metal fabrication in an efficient manner except for coatings, and micro-bacterial cleaning/coatings where notable strides have been made. Some induction coupled plasmas (4000–12000 C) and transferred arc plasmas (~6000 C) which have been used in metallurgical industrial practices for gas modification or for the development of high temperature deposited coatings (e.g. plasma deposition of thermal barrier coatings on aircraft blades). These plasmas are difficult to direct or transfer in tubes to locations other than where they exist (typically between electrodes).

Several uses for very low temperature (cold) plasmas are also known for polymer systems processing. Cold plasmas are used for polymer surface cleaning or polymerization purposes. The effect of a plasma impingement on a given material is determined by the chemistry of the reactions between the surface and the reactive species present in the plasma. At the low-exposure energies typically present in glow-discharge plasma systems, the interactions occur only in the top few molecular layers. This layer is deeper for higher temperature plasmas. Plasma surfaces have unique reactions which are well known for low temperature plasmas and polymers but not as well know for metallic surfaces and medium temperature plasmas. In the case of polymers which are treated by cold plasmas, the gases, or mixtures of gases, used for the cold plasma treatment include air, nitrogen, argon, oxygen, nitrous oxide, helium, tetrafluoromethane, water vapor, carbon dioxide, methane and ammonia. Each gas produces a unique plasma composition and results in different polymer surface properties. For example, the high surface energies required for wettability and chemical reactivity may be increased very quickly and effectively by plasma induced oxidation, nitration, hydrolyzation, or amination (ammonia processing). Conversely, plasma induced fluorination depresses the surface energy, producing an inert and non-wettable surface. Such affects are often utilized for powder coating.

The two extreme plasmas (very hot and room temperature) mentioned above are mostly unsuitable for metallurgical work because of the extreme temperatures and very poor efficiencies. Although some plasma temperatures from conventional generators may be manipulated to have lower temperatures, there are other problems for economical use when such modifications are attempted. For example transferred arc induc ion plasmas are noisy and extremely costly for use in the 700 C range of temperatures where aluminum is melted and cast. Additionally, the conversion efficiency and power transfer efficiency of the transferred arc plasma is very low (single digits for these low temperatures) thus negating economical use. A new mid temperature range (700 C1300 C) convective plasma device is described herein. This new system is extremely quiet and seemingly offers the possibility of close to 100% power transfer efficiency. The use of this source with the novel heat transfer mechanism is expected to give rise to a host of new energy efficient technologies. It is to be noted here that until the availability of the this technology for medium temperature plasmas it was commonly recognized that thermal plasma processing faces a untenable economic prognosis in commercialization. Whenever conventional plasmas were considered in the past for metallurgical processing, invariably cost considerations prevented large scale applications, a fact highlighted often in the classic review by Pfender (E. Pfender, Plasma Chemistry and Plasma Processing, Vol.1, No.1, 1999, pg.1-28). The importance of this invention is made more obvious by the manageable cost of systems which can now become available. It is important therefore to develop processes with medium temperature plasmas. In this light, several plasma processes contemplated in (Plasma and laser Processing of Materials, eds. K. Upadhaya, TMS, 1991, and Carbide, Nitride and Boride Materials Synthesis and Processing, eds. Alan W. Weimer, Chapman Hall, 1997, could also benefit with the new source (this invention).

The plasma of this invention also may be used to vastly enhance heat transfer to a solid in order to improve productivity and save in the power lost to the surroundings by (i) concentrating the heat on the solid on account of the charge separation in the plasma and (ii) saving energy by processing faster such that the time in which it takes to melt a solid is so low that the surrounding device has little time to loose heat.

In an example below we find that heating the solid by the plasma of this invention uniquely allows the heat transfer coefficient to increase by orders of magnitude when compared to heating only by convection without plasma. Although, plasmas have been used to heat solids in the past, most heating configurations with the solids involve holding the solid (often a powder) inside the plasma. In the designs now possible, described below, the plasma is directed at the solid inside a chamber containing the surfaces to be heated which is kept far away from the plasma generating source which also provides for forced convection. Such solids can for example be aluminum ingots or scrap aluminum parts which require melting or iron surfaces requiring nitriding. The theoretical reason to expect such a benefit in heat transfer coefficient is discussed below.

Theoretical determination of the heat transfer coefficient (H) is an extremely difficult theoretical problem therefore numerous empirical and semi-empirical correlations are used to describe heat transfer to a spherical particle in a laminar flow. One of the popular methods is the Ranz-Marshall formula which describes the Nusselt number (Nu) for heat transfer to a spherical particle.

$$Nu=A+B\ Re^{n}Pr^{m}$$

Here the constants A, B, n, m, are typically, 2, 0.6, 0.5; 0.5 respectively for forced convective flow over small particles.

Here Nu and Re are Nusselt and Reynolds numbers, respectively. These numbers are defined by the following equations:

$$Nu=Hd_p/\bar{\lambda}_p \quad (6)$$

$$Re=[d_p/v_f-v_p/\bar{\rho}_f]/\bar{\mu}_f$$

(see below for definition of symbols)

And where Pr is the Prandtl number defined as $$Pr=\bar{c}_f\bar{\mu}_f\bar{\lambda}_p^{-1}$$

where $p_p$ is the density, $c_p$ is the specific heat capacity at constant pressure, $\lambda_p$ is the thermal conductivity, $T_p$ is the absolute temperature, $r_p$ and $d_p$ are the radius and diameter of the particle, the dynamic viscosity is $\mu_f$, the velocity is v. f and p signify fluid and particle respectively. The bars signify averaged temperature values. The particle temperature is the function of time $\tau$ and its radial coordinate r.

There is a problem with fitting data if fluid plasma conditions exist and the classic paper of Young and Pfender (R. M. Young and E Pfender 1987 Nusselt Number Correlations To Small Spheres In Thermal Plasma Flow, Plasma Chemistry And Processing Vol.7 No.2 Pg211-226) showed early on that a plasma Nusselt number could be envisaged or defined which yields a higher heat transfer value that any modification of the RanzMarshall formula. It is believed that this plasma Nusselt number is very high although no real data exists to demonstrate this theoretical assertion.

Gasses like Nitrogen are able to dissociate at low temperatures.

Effectively the following reactions are occurring.

$N_2$+E=2N Diatomic molecule of nitrogen+energy gives 2 free atoms of nitrogen

2N+E=$2N^+$+$2e^-$2 free atoms of nitrogen+energy gives 2 nitrogen ions and 2 electrons The new technique being proposed here is that this energy be transferred to a electrically conduction surface such as aluminum in order to deposit the energy to the electrical surface without it being lost to the surroundings, thus making the energy transfer extremely efficient compared to ordinary convective heating.

Now on the surface of a part especially if the surface is electrically conducting, where electrons are available in abundance, the following reaction can occur:

$$2N^++2e^-=2N+E$$

$$2N=N_2+E$$

This is the manner in which heat automatically deposits on the surface of alumirum thus increasing the energy transfer rate (i.e. $H_{plasma}$) substantially. For powder applications nitrogen is a general purpose primary gas used alone or with hydrogen secondary gas. Nitrogen also benefits from being the cheapest plasma gas. Nitrogen tends to be inert to most spray material except for materials like titanium. Argon is probably the most favored primary plasma gas and is usually used with a secondary plasma gas (hydrogen, helium and nitrogen) to increase its energy. Argon is the easiest of these gases to form a plasma and tends to be less aggressive towards electrode and nozzle hardware in powder melting and deposition hardware. Most plasmas are started up using pure argon. Argon is a noble gas and is completely inert to all spray materials. Hydrogen is mainly used as a secondary gas, it dramatically effects heat transfer properties and acts as anti-oxidant. Small amounts of hydrogen added to the other plasma gases dramatically alters the plasma characteristics and energy levels and is thus used as one control for setting plasma voltage and energy. Helium is mainly used as a secondary gas with argon. Helium is a noble gas and is completely inert to all spray materials and is used when hydrogen or nitrogen secondary gases have deleterious effects. Helium imparts good heat transfer properties and gives high sensitivity for control of plasma energy. It is commonly used for high velocity plasma spraying of high quality carbide coatings where process conditions are critical.

To date no device exists by which plasma energy can be transferred in the mid temperature rage economically to a surface. This is the device and technique claimed in this application.

BACKGROUND OF THE INVENTION

Today, hot air blowers based on US5,963,709 (incorporated herein fully) are used for a variety of applications including direct heating of part surfaces, incineration of gas particulates, and heating enclosed chambers. More particularly, hot air blowers can be used for refractory curing, plastics sealing, cleaning diesel exhaust, and retrofitting gas fired ovens and furnaces.

Such blowers typically comprise a blower fan, an electric heating element, and a housing of the heating element. The blower fan forces air into the housing through an inlet at one end of the blower. The air is then heated by convection and radiation as it passes near the heating element and is provided at the outlet at the opposite end of the blower.

Accordingly, it is desirable to construct a hot air blower that can produce higher gas temperatures than current hot air blowers. Furthermore, it is desirable to produce a hot gas blower that has higher energy efficiency than current blowers. Further more it is very important to produce hot gas blowers which produce and transfer plasma instead of simply hot un-dissociated hot gas because such a method dramatically improves the heat transfer coefficient. Moreover, it is desirable to produce a hot plasma blower that does not cause the metallic heating element used within it to crack when the element reaches a certain temperature relative to the air passing near it.

This is the mid temperature plasma blower described herein.

SUMMARY OF THE INVENTION

It is an object of this invention to provide a device and method for heating a gaseous flow that can impart plasma to the flow.

It is a further object of the invention that this plasma posses kinetic energy so that it may be able to be delivered convectively to a conductive or non conductive part surface. It is another object of the present invention to provide a device and method for heating a gaseous flow that has high energy transfer efficiency.

It is yet another object of this invention to provide a device and method for heating a gaseous flow that can be used with a metallic or ceramic (such as molybdenum disilicide, silicon carbide, zirconia, carbon or boron nitride) heating elements at high temperatures without causing the element to crack.

A further object of this invention is to provide a device and method for heating a gaseous flow that provides an ideal residence time for the flow.

Another object of this invention is to provide a device and method for heating a gaseous flow that utilizes a pair of porous materials to provide a tortuous path for the flow and an increased residence time for heating the flow. U.S. Pat. No. 5,558,760 (the '760 patent) and U.S. Pat. No. 5,279,537 are incorporated in their entirety herein as it relates to the composition of the porous material. Note that the heating element described in the '760 patent may be the porous material itself.

To achieve the foregoing and other objects and in accordance with the purposes of the present invention as described above, a device for heating a gaseous flow is provided having a first materials, a second materials, and a heat source. The first materials has an inlet side for receiving the gaseous flow, an inner side for discharging the gaseous flow, and a plurality of openings, the openings providing at least one passageway for the inlet side to the inner side. The first materials preferably comprise porous ceramic materials.

The second materials has an inner side for receiving the gaseous flow, an outlet side for discharging the gaseous flow, and a plurality of openings, the openings providing at least one passageway from the inner side to the outlet side. The inner side of the first materials and the inner side of the second material define a gap for providing residence time for gases passing therethrough. Preferably, the second material comprises a porous ceramic materials. It is also preferred that the ratio of the volume of the materials to the volume of the gap is 3. The heat source is in direct or indirect contact with the gaseous flow and provides heat thereto. Preferably, the heat source is an electric heating element.

A method of heating a gaseous flow is also provided comprising the steps of providing a first materials, a second materials, and a gap therebetween, and forcing a gaseous flow through the first materials, the gap, and the second material. The first material and the second material are preferably comprise a porous ceramic material. It is also preferred that the ratio of the volume of the materials to the volume of the gap is about 3.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which: FIG. 1 is a side perspective view of the plasma device of the present invention: Note that this figure is similar to FIG. 1 in U.S. Pat. No. 5,963,709 except for the introduction of a body comprising tungsten, either by itself in a solid form inserted into the thero-electric field of the hot gas device (labeled Al or A2 in FIG. 1, we have found that the placement is possible anywhere in the thermoelectric field) or in the composition of the heating elements (item 32 in the drawing, i.e. ehen one or all of the electric heating element contains tungsten).

FIG. 2 illustrates the concept of energy deposition by a plasma in conjunction with fluid thermal energy deposition.

DETAILED DESCRIPTION OF THE INVENTION

Referring now to the drawings in detail, wherein like numerals indicate the same elements throughout the views. FIG. 1 is a side perspective view of a preferred embodiment of the present invention. As shown in FIG. 1, hot plasma blower 12 has a housing comprising a stainless steel shell 14 configured in a substantially cylindrical shape. The blower 12 has an inlet end 20 and an outlet end 22. A fan 16 is disposed near the inlet end 20 for receiving a gaseous flow, depicted by the arrows 18, so that the gaseous flow can be directed through the blower 12 from its inlet end 20 toward its outlet end 22. Fan 18 is preferably driven by an electric motor (not shown). The rest of the numbers are as described in U.S. Pat. No. 5,963,709.

The gaseous flow 18 to be heated by the blower 12 can comprise a variety of gases or combinations of gases. For example, the gaseous flow 18 can be air containing nitrogen that is to be heated and applied to a part or chamber. Also, the gaseous flow can be engine exhaust having particulates that are to be incinerated by the heat of the blower 12. Moreover, although the blower 12 is depicted in its vertical position FIG. 1, it may be operated in a horizontal manner or at an angle to horizontal. Note (Al) and (A2) are embodiments of this invention namely the introduction of a tungsten body either by itself in the thermo-electric field or by the addition of tungsten compounds in or on the heating elements.

The figures displayed in U.S. Pat. number 5,963709 are incorporated herein, as the device is an improvement on the device patented in U.S. Pat. No. 5,963,709 comprising additionally of a tungsten bearing material in the thermoelectric field of the device.

The heating clement should be made of a resistive material such that it becomes heated as an electric current passes there through as is well known in the art. The element can comprise any number of resistive materials suitable for obtaining a high temperature when an electric current passes there through. For example, the element can comprise a metallic material such as iron or nickel based alloys, iron or nickel based alloys containing aluminum and niobium, nickel aluminide, molybdenum disilicide (or other molybdenum silicides), silicon carbide, nickel chromium alloy, and the like. Conventional U-shaped elements based on molybdenum disilicide, silicon carbide, zirconia, carbon or boron nitride can be heated up to a 1900° C. element temperature. While the heating element is shown as a U-shaped in FIG. 1, it is to be understood that the heating element can comprise any number of shapes and types as are well known in the art. For example, the heating element can have a multiple number of connected U-shaped members or can be provided in a spiral shape or as coil shape or combinations. In one embodiment of this invention we provide for adding tungsten or tungsten bearing compounds to the heating element itself in order to obtain a convective plasma output from the product of this invention.

As an alternative to an electric heating element, other heat sources may be utilized to heat gases flowing through the blower. For example, the gaseous flow can be heated by a gas burner such as the burners used in gas furnaces and ovens. Furthermore, the heat source could be located in several possible locations including the gap, the first material, and/or the second material.

Although air is the gas discussed, it is contemplated that any reactive or non reactive gas may be used.

Furthermore, it is contemplated that hot air could be drawn directly out of the gap as it is simultaneously drawn from the outlet end of the blower or compressor or gas bottle delivering the gas. Moreover, additional fans may be utilized to aid in drawing the air from the blower. It is also contemplated that fins or baffles be utilized within the gap to aid in increasing residence time and raising the temperature of the air output from the fan. In operation, the blower, fan or compressor forces air (or other gas if desired) into the inlet. When the air reaches the first material, it travels from the inlet side, through the pores, and out the outlet side. As noted above, the pores preferably provide a plurality of passageways through which the air may travel. It is even more preferred that the passageways have several turns and twists so that the air travels a "tortuous" path, as is known in the art. As also noted above, the pores within the material are preferably interconnected so that each pore is connected to a plurality of passageways extending from the inlet side to the inner side. The first material has a preferred porosity of 10 pores per inch, each pore having a diameter of about 0.01 inches.

The tortuous path provided by the pores serves at least two functions. First, as air travels the tortuous path, it absorbs the heat retained by the first material and received from the heating element. This preheating of the air helps to prevent the heating elements from cracking, as metallic elements have been known to do when they comc in contact with air that is too cool relative to the temperature of the element. The amount of preheating that occurs depends upon the thickness of the material, the porosity of the material, and the size of the pores. The greater the thickness and porosity, the more tortuous the path. The larger the pore size, the less tortuous the path.

The second function of the tortuous path is to help to prevent air from escaping the blower in the opposite direction of the intended flow. Thus, although air that becomes heated will have a tendency to rise from the inner side to the inlet side when the blower is used in the vertical position, the air will have difficulty doing so due to the complex and turbulent flow experienced within the gap upon exiting the material.

Once the air is discharged from the inner side, it enters the gap defined by the first material, the second material and the interior wall of the spacer. The gap can also be described as a cavity, space, or chamber. When air travels through the gap, it receives heat from the element by convection and radiation. The gap provides residence time for the air traveling from inner side of the first material to the inner side of the second material to become heated by the element. It is also believed that a complex combination of turbulent flow, convective flow, and recirculation zones occurring within the gap contribute to the heat imparted to the gas therein. Thus, when the air reaches the inner side of the second material, it has a higher temperature than when it first entered the gap through the inner side of the first material.

Like the first material, the second material also have a number of pores which are preferably interconnected so as to provide a tortuous path from the inner side to the outlet side of the material. It is also preferred that the second material have the same porosity of the first material. As in the first material, the pores of the second material provide a tortuous path for air traveling through the second material and cause the air to rise even higher in temperature as it travels through the material. The element in addition to being disposed within the gap, is preferably also disposed within the second material so as to provide additional heating of the air. The air is finally discharged through the outlet side of the second material and out the outlet end of the blower where is can be utilized by the user. Due to the tortuous paths provided by the materials and, the residence time provided by gap, the air exiting the blower at the outlet end is at a higher temperature than air brought into the blower through the inlet end.

It has been found that by providing materials and air gap, the blower no gap were present. It has also been found that particular ratios of the volume of the materials and to the volume of the gap provide higher temperature increases than other ratios. ("Volume of the materials 24 and 26" means the sum of the volume of material and the volume of material.) More particularly, it is preferred that the ratio of the volume of the materials and to the volume of the gap be between about 0.2 and about 5, it is even more preferred that this ratio be between about 2.5 and about 3.5 and it is most preferred that the ratio be about 3.0. It is believed that this ratio provides ideal residence time for air within gap to absorb heat from the element.

Moreover, it is believed that if the width of the gap (the distance from the inner side to the inner side) is too small, not enough residence time is provided for the air to absorb heat. Conversely, it is believed that if the width of the gap is too large, air in the gap begins to rise and is not properly discharged from the blower, causing cooler air to be discharged instead. Accordingly, it is preferred that the ratio of the sum of the average thickness of the materials and to the average thickness of the gap be between about 1 and about 5; it is more preferred that this ratio be between about 2.5 and 3.5 and it is most preferred that this ratio be about 3.0. Average thickness, as used herein, means the sum of the thickness measured at x discrete points, divided by x. In a preferred embodiment, the first material has a uniform thickness of 1.5 inches from the inlet side to the inner side, the second material has a uniform thickness of 3.0 inches from the inner side to the outlet side, and the gap has a uniform thickness of 1.5 inches.

The invention and best mode to date is illustrated by the following example.

EXAMPLE

We did a simple experiment to compare the heat transfer efficiency in convection with plasma and without plasma. 0.5 kg of aluminum was placed in a standard of the shelf convective oven which was modified to have an approximate 3 m/s velocity through the orifice which delivered 900 C hot air to the furnace wit a standard wire mesh heater with fan, called the LTA which is a device which produces hot air up to 900 C but no plasma (see www.mhi-inc.com). The oven was also fitted with standard Ni—Al—Cr—Nb—wire heaters and heated to 1100 C. An average oven temperature was read from the embedded thermocouples as being 1020 C. The charge was cut into 1" cylinders (2" in length). The melting time from start to finish was 3 minutes (which yields a melt rate of about 2.8 g/sec). In addition it took over 1 hour for the oven to reach temperature.

The hot air device of U.S. Pat. No. 5,963,709 was modified with a 3 mm rod containing a tungsten compound and inserted into the hot air stream in the device at the hottest point (base). After a while the hot air began to glow in a manner that indicated plasma formation. The best mode of practice that we have been able to determine to date is that the inserted tungsten rod compound be about 3 mm in diameter and at least 10 mm in length. The insertion of the tungsten compound caused plasma formation and also increased the measured gas temperature.

The maximum temperature (1400 C) provided at the outlet of the blower with a 2 mm gap in the outlet was obtained when the ratio of the foam volume to the air gap volume was about 3.0 (the volume of each of the three pieces of ceramic foam was about 42.4 cubic inches and the volume of the gap was about 42.4 cubic inches). As noted above, it is believed that this occurred because this ratio provides the ideal residence time for the air flowing through the blower to absorb the heat provided by the heating element.

A further example was the construction of the hot air device of U.S. Pat. No. 5,963,709 with heating elements containing tungsten (U.S. Pat. No. 6,099,978). Surprisingly a high glow plasma was again obtained compared to the case when the no tungsten was used in the heating element. A corresponding higher temperature of about 200 C higher was also recorded. This plasma could be directed to a surface such as aluminum, the plasma could also be made to flow inside a channel, the plasma could also quickly heat and soften a plastic bolt in a time less than Isecond after impingement. As the plasma temperature is in the order of$1.1\times10^3$ C the plasma can flow in common tube materials and be directed. Most hot plasmas hithertofore were too hot to contain.

In the best mode known to date we find that using tungsten containing molybdenum disilicide heating elements of diameter 2–6 mm in a U or coil configuration yielded a plasma at a temperature of about 1110° C. For coating applications experiments indicated that plasma assisted coatings could be applied on metals, alloys and ceramic substrates with a very little investment unlike the physical or chemical vapor deposition. 3 to 4 KW power devices using air as gaseous medium has produced reddish colored plasma typical of air. Good adherent coatings including bronze on aluminum, tungsten carbide on alumina and aluminum on alumina were produced on a substrate. Powdered precursor made to flow in to plasma when exit temperatures were in the range of 1140 to 1300° C. Typical gas flow rates were maintained in the range of 4 to 5 CFM.

A 0.5 Kg cylindrical charge was placed in a crucible (randomly stacked), a plasma device (invention herein) was placed over it and the thermocouple set to 1 OOOC at the exit of the plasma Airtorch. The plasma device was kept facing the sample and the same 0.5 Kg charge was observed from a gap between the plasma Airtorch and the crucible lip. Full melting was noted to occur in 42 seconds (12 g/s melting rate). The plasma took 4 seconds to appear and the top unit was removed soon after melting. Clearly the plasma assisted the melting rate thus indicating a much greater melting efficiency. The reason for such a benefit is easily understood from the plasma energy deposition discussed in a section above.

Having shown and described the preferred embodiments of the present invention, further adaptations of the device for heating a gaseous flow described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the structures and methods shown and described in the specification and drawings.

The product of this invention may be used for several applications. Some are given in the first pages of this application where the plasma uses are described for hot and cold plasmas. In addition the following applications present themselves namely: use in an aluminum melter (i.e. liquid metal handling and processing during melting or during transfer in launders), stake welder (i.e. for quick melting and fusing of organic materials), cleaning of syringes and needles (plasma cleaner), metallurgical processing, plasma nitriding with air input (into the plasma device) as the low cost nitrogen source and several others where clean directed heating is required such as in food processing. Other applications could be in Heat treatment (annealing, stress relieving, tempering, artificial ageing), die heating, fluidized bed, drying, sintering, de-binder, welding, diffusion bonding, sealing, glass industry, high temperature sensor testing and certification, and plasma furnaces and ovens.

The product of this invention uniquely produces a medium temperature plasma and is able to convectively direct the plasma at a surface. No other device is able to do so. The benefits of the device are enormous as it appears to converts air to plasma and is able to cleanly melt aluminum or cause surface nitriding all from an air source. Nitriding is commonaly known in the art as a process where the surface of a part is reacted to form nitride compounds in order to increase the hardness of the surface.

The plasna device may be used in a container such as an oven or furnace.

In the claims below mention is made of the thermo-electric environment of the device. This refers to the region where both heat and electric fields are noted on account of the device. A container containing the plasma device is for example an oven or furnace and may additionally contain other heaters (herein refereed to as no-plasma heaters).

What is claimed is:

1. A plasma device for heating a gaseous flow comprising:

A first material having an inlet side for receiving a gaseous flow, an inner side for discharging said gaseous flow, and a plurality of openings, said openings providing at least one passageway from said inlet side to said inner side:

A second material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween, wherein the ratio of the sum of the volumes of the first and second materials to the volume of the gap is between about 0.2 and 5; And A heat source in heat transfer relation with said gaseous flow for heating said gaseous flow, with an improvement comprising of a tungsten containing material in the thermo-electric environment of the device.

2. The device as recited in claim 1 wherein said heat source is disposed at least partially within said device for heating said gaseous flow, with an improvement comprising of a tungsten containing material in the thermo-electric environment of the device.

3. The device is recited in claim 1 wherein said plurality of openings of said first material is a plurality of pores, and wherein said plurality of openings of said second material is a plurality of pores, with an improvement comprising of a tungsten containing material in the thermo-electric environment of the device.

4. The device as recited in claim 3 wherein said plurality of pores of said first material are interconnected, and wherein said plurality of pores of said second material are interconnected, with an improvement comprising of a tungsten containing material in the thermo-electric environment of the device.

5. The device as recited in claim 1 further comprising:

a fan in fluid communication with said inlet of said first material, said fan being operative for creating said gaseous flow between said first inlet side and said outlet side and with an improvement comprising of a tungsten containing material in the thermo-electric environment of the device.

6. The device as recited in claim 5 further comprising an insulating material substantially contiguous with said inlet said of said first material, with an improvement comprising of a tungsten containing material in the thermo-electric environment of the device.

7. The device as recited in claim 1 wherein said first material and said second material comprise a porous ceramic material, with an improvement comprising of a tungsten containing material in the thermo-electric environment of the device.

8. The device as recited in claim 7 wherein said porous ceramic material is selected from the group consisting of borides of titanium, zirconium, niobium, tantalum, molybdenum, hafnium, chromium, and vanadium; aluminides (except of aluminum) carbides and oxides of titanium, hafnium, boron, aluminum, tantalum, silicon, tungsten, zirconium, niobium, iron, molybdenum, vanadium and chromium: carbonitrides of titanium, niobium and tantalum; nitrides of titanium, zirconium, boron, aluminum, silicon, tantalum, hafnium, and niobium; silicides of molybdenum, titanium, zirconium, niobium, tantalum, tungsten and vanadium; hybrids of titanium, zirconium and niobium, with an improvement comprising of a tungsten containing material in the thermo-electric environment of the device.

9. The device as recited in claim 1 wherein said first material and said second material comprise a porous sodium silicate cement having a colloidal alumina coating, with an improvement comprising of a tungsten containing material in the thermo-electric environment of the device.

10. Thc device as recited in claim 1 wherein the ratio of the sum of the volumes of the first and second materials to the volume of the gap is between about 2.5 and about 3.5, with an improvement comprising of a tungsten containing material in the thermo-electric environment of the device.

11. The device as recited in claim 1 wherein the ratio of the sum of the volumes of the first and second materials to the volume of the gap is between about 2.9 and about 3.0, with an improvement comprising of a tungsten containing material in the thermo-electric environment of the device.

12. The device as recited in claim 1 wherein the heat source is a heating element, with an improvement comprising of a tungsten containing material in the thermo-electric environment of the device.

13. The device as recited in claim 12 wherein the heating element extends from the inner side of the first material through the outlet side of the second material, with an improvement comprising of a tungsten containing material in the thermo-electric environment of the device with an improvement comprising of a tungsten containing material in the thermo-electric environment of the device.

14. The device as recited in claim 1 wherein the first material is conductive and wherein the heat source comprises the first material, with an improvement comprising of a tungsten containing material in the thermoelectric environment of the device.

15. The device as recited in claim 14 wherein the second material is conductive and wherein the heat source further comprises the second material, with an improvement comprising of a tungsten containing material in the thermo-electric environment of the device.

16. A method of heating a gaseous flow comprising the step of:

providing a first material having an inlet side, an inner side, and a plurality of openings, said openings providing at least one passageway from said inlet side to said inner side:

providing a second material having an inner side, an outlet side, and a plurality of openings, said openings providing at least one passageway from said inner side to said outlet side, wherein said inner side of said first material and said inner side of said second material define a gap there between, wherein the ratio of the sum of the volumes of the first and second materials to the volume of the gap is between about 0.2 and 5; and forcing gas through said first material, said gap, and said second material, with an improvement comprising of a tungsten containing material in the thermo-electric environment of the device.

17. The method as recited in claim 16 further comprising the step of:

providing a heat source in heat transfer relation with said gaseous flow, with an improvement comprising of a tungsten containing material in the thermo-electric environment of the device.

18. The method of claim 16 wherein the first material and the second material are provided and configured such that the ratio of the sum of the average thicknesses of the first and second materials to the average thickness of the gap is between about 2.5 and 3.5, with an improvement comprising of a tungsten containing material in the thermo-electric environment of the device.

19. The method as recited in claim 16 wherein said gas is forced by use of a fan, with an improvement comprising of a tungsten containing material in the thermo-electric environment of the device.

20. A device for heating a gaseous flow comprising:

a first material having an inlet side for receiving a gaseous flow, an inner side for discharging said gaseous flow, and a plurality of openings, said openings providing at least one passageway from said inlet side to said inner side:

a second material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween for providing residence time for gases passing therethrough, wherein the ratio of the sum of the average thickness of the first and second materials to the average thickness of the gap is between about 1 and 5; and a heat source in heat transfer relation with said gaseous flow for heating said gaseous flow, with an improvement comprising of a tungsten containing material in the thermo-electric environment of the device.

21. The device as recited in claim 20 wherein the ration of the sum of the average thicknesses of the first and second materials to the average thickness of the gap is about 3, with an improvement comprising of a tungsten containing material in the thermo-electric environment of the device.

22. A device for heating a gaseous flow comprising:

a first porous ceramic material having an inlet side for receiving a gaseous flow, an inner side for discharging said gaseous flow, and a plurality of openings, said openings providing at least one passageway from said inlet side to said inner side;

a second porous ceramic material having an inner side for receiving said gaseous flow, an outlet side for discharging said gaseous flow, and a plurality of openings, said openings providing at least one passageway from said inner side to said outlet side, wherein said inner side of said first material and said inner side of said second material define a gap therebetween for providing residence time for gases passing therethrough, wherein the ratio of the sum of the volumes of the first and second materials to the volume of the gap is between about 1 and about 5; and a heat source in heat transfer relation with said gaseous flow for heating said gaseous flow, with an improvement comprising of a tungsten containing material in the thermo-electric environment of the device.

23. A device of claim 1 which may be directed at an electrically conducting surface in order to improve the rate of heat transfer to that surface.

24. A container incorporating the device of claim 23.

25. A container comprising of the device of claim 1 and a non-plasma heater.

26. The device of claim 1 wherein gasses are mixed with the plasma.

27. The product of claim 1 which may be directed at an electrically non conducting surface in order to improve the rate of heat transfer to that surface.

28. A container incorporating the device of claim 27.

29. A container incorporating the device of claim 1.

30. A device of claim one for convectively transferring plasma.

31. A device of claim 1 for use for melting aluminum.

32. A device of claim 1 for use as a polymeric stake welder.

* * * * *